US005926686A

United States Patent [19]

Engström et al.

[11] Patent Number: 5,926,686

[45] Date of Patent: Jul. 20, 1999

[54] SINTERED PRODUCTS HAVING IMPROVED DENSITY

[75] Inventors: Ulf Engström; Björn Johansson, both of Höganäs, Sweden

[73] Assignee: Höganäs AB, Hoganas, Sweden

[21] Appl. No.: 08/969,542

[22] Filed: Nov. 13, 1997

Related U.S. Application Data

[63] Continuation of application No. 08/732,471, filed as application No. PCT/SE95/00497, May 5, 1995, abandoned.

[51] Int. Cl.[6] ..... B22F 3/12

[52] U.S. Cl. ..... 419/37; 419/38; 419/46; 419/54; 75/246

[58] Field of Search ..... 419/37, 38, 46, 419/54; 75/246

[56] References Cited

U.S. PATENT DOCUMENTS

| | | | |
|---|---|---|---|
| 4,483,905 | 11/1984 | Engstrom . | |
| 5,108,493 | 4/1992 | Causton . | |
| 5,154,881 | 10/1992 | Rutz et al. | 419/37 |
| 5,256,185 | 10/1993 | Semel et al. | 75/255 |
| 5,298,055 | 3/1994 | Semel et al. . | |
| 5,498,276 | 3/1996 | Luk . | |

FOREIGN PATENT DOCUMENTS

| | | |
|---|---|---|
| 2749215 | 11/1983 | Germany . |
| 334244 | 4/1971 | Sweden . |
| 468121 | 11/1992 | Sweden . |

*Primary Examiner*—Daniel J. Jenkins
*Attorney, Agent, or Firm*—Burns, Doane, Swecker & Mathis, L.L.P.

[57] ABSTRACT

The present invention concerns low allow PM materials which after single pressing and sintering utilizing traditional powder metallurgy processes and equipment combine high mechanical strength and high density with maintained precision of tolerance. As base material is used an iron powder having at least one alloying element diffusion-bonded to the outer surfaces of unalloyed iron particle is provided.

27 Claims, No Drawings

SINTERED PRODUCTS HAVING IMPROVED DENSITY

This application is a continuation of application Ser. No. 08/732,471, filed Nov. 5, 1996, now abandoned, which is a 371 of PCT/SE95/00497 filed May 5, 1995.

FIELD OF THE INVENTION

The present invention concerns sintered powder-metallurgically produced sintered products having improved density. More specifically the invention concerns products prepared from iron or steel powders having the alloying elements diffusion-bonded to the iron or steel particles. These products are prepared by a warm-compaction process using high temperature lubricants.

BACKGROUND OF THE INVENTION

The market for sintered structural components could be markedly extended if enhanced mechanical properties could be obtained with maintained precision of tolerance control. Higher densities than the range currently produced (6.5–7.2 g/cc) would be required for more highly stressed applications in automotive engineering as density affects the mechanical properties and fatigue strength in particular.

A number of options are available to increase sintered density. Methods such as double pressing/double sintering, copper infiltration and powder forging provide higher densities than traditional single press and sintered operations but their use is constrained by cost and geometry considerations. In order to retain competitive viability a satisfactory process route is required which will not add any extra processing step which will increase the processing cost.

SUMMARY OF THE INVENTION

The present invention concerns low alloy PM materials which after single warm pressing and sintering utilising traditional powder metallurgy processes and equipment combine high mechanical strength and high density with maintained precision of tolerance. These materials are obtained according to a process including the following steps:

mixing an iron powder, a high temperature lubricant and optionally an organic binder;

heating the mixture, preferably to a temperature of at least 120° C.;

transferring the heat powder composition to a die which is preheated to a temperature of preferably at least 120° C.; and compacting the composition, at an elevated temperature of preferably at least 120° C.

sintering the compacted body at a temperature of at least 1120° C.;

whereby the iron powder is a diffusion-bonded powder having one or more alloying elements diffused into the outer surfaces of unalloyed iron particles, and whereby the lubricant is added in one step.

The U.S. Pat. No. 5,154,881 discloses metal compositions subjected to a warm compacting process. Compacted and sintered products prepared according to this patent exhibit improved densities and other strength properties and the advantages are obtained when the increased pressing temperatures are applied to iron based powders, which could be pure iron powders, mixtures of iron powders with alloying elements or pre-alloyed iron powders.

The U.S. Pat. No. 5,256,185 discloses a method for the preparation of a powder metallurgical product, wherein an iron powder, a lubricant and a binder are mixed, the mixture is compacted at an elevated temperature and the compacted body is subsequently sintered.

More specifically, this patent concerns a method of lubricant addition, which enables suitable adjustment of the apparent density, either upwards or downwards, as decided, without significant effect on the flow rate. This is accomplished by the following steps: (a) providing a dry admixture of an iron based powder, at least one alloying powder and a first amount of organic lubricant, (b) providing a liquid mixture of an organic binding agent dissolved or dispersed in a solvent, (c) wetting the dry admixture with the liquid mixture, (d) removing the solvent thereby forming a dry powder composition and (e) admixing a second amount of organic lubricant with the dry powder composition to form a metallurgical powder composition.

Contrary to the process disclosed in this US patent the present invention includes only one lubricant addition step. Furthermore, the present invention does not concern a method of manipulating the apparent density and thus the present invention concerns a quite different problem than the problem which is solved by the invention disclosed in the US patent.

Quite unexpectedly, it has now been found that increased densities and consequently improved mechanical properties can be obtained if the iron powder is a diffusion-bonded powder having one or more alloying elements diffused into the outer surfaces of unalloyed iron particles. Examples of such diffusion-bonded powders are Distaloy AB, Distaloy AE, Distaloy SA and Distaloy SE, all available from Höganäs AB, Sweden. These powders are all distinguished by a low carbon content, i.e. a carbon content below 0.01% by weight.

The invention is further defined by the accompanying claims.

The high temperature lubricant is generally one which can withstand a compaction temperature up to about 370° C. Examples of such lubricants are molybdenum sulphide, boric acid and those polyamide lubricants which are disclosed in the U.S. Pat. No. 5,154,881 which is hereby incorporated by reference. Particularly preferred are the commercially available lubricants ADAVAWAX 450 or PROMOLD 450, polyamide sold by Morton International of Cincinnati, Ohio, which according to the US patent is an ethylene bis-stearamide having an initial melting point between about 200° C. and 300° C. Other lubricants which could be used are oligomers of "polyamide" type as described in our copending Swedish patent application 9401922-1 filed Jun. 2, 1995 which is hereby incorporated by reference. These lubricants may be used in combination with minor amounts, e.g. from 0.05 to 0.15% by weight, of conventional lubricants for cold-compaction, e.g. metal stearates, such as zinc stearate. The total amount of lubricant is 0.1–2, preferably 0.2–1% by weight of the composition.

The binding agent is preferably a cellulose ester such as those manufactured by Eastman Chemical products designated as CA, CAB and CAP resins. If present, the binding agent is used in an amount of 0.01–0.40% by weight of the composition.

The invention is further illustrated by the following examples.

Materials Tested

The following two mixes were prepared using the special developed lubricant/binder system for warmcompaction:

1) Distaloy AE+0.6% graphite+0.6% lubricant/binder

2) Distaloy DC*−1+0.6% graphite+0.6% lubricant/binder

*pre-alloyed iron-powder for comparison

The lubricant used was Promold 450 and the binder was a cellulose ester. The weight ratio lubricant/binder was 3:1.

The same mixes were also prepared using 0.8% zinc-stearate as lubricant for conventional processing at room temperature.

Processing Conditions

Tensile test and TRS specimens were compacted at pressure of 400, 600 and 800 MPa on a mechanical DORST-press, using both the warmcompaction process as well as the conventional single pressing/single sintering (1P1S).

The compacted specimens were sintered at 1120° C. for minutes in endothermia atmosphere with controlled carbon potential.

Green and sintered properties were analysed according to standard test methods, i.e.

the green density according to ISO No 3927-1977 the green strength according to ISO No 3995-1977 the sintered density according to ISO No 3369-1975 and the tensile strength according to ISO No 2740-1973

The powder properties are summarised in the following table.

| | | Warm compacting | | | Cold compacting | | |
|---|---|---|---|---|---|---|---|
| Compacting pressure | | 400 | 600 | 800 | 400 | 600 | 800 |
| GD [g/cc] | Distaloy AE | 7,05 | 7,30 | 7,39 | 6,80 | 7,10 | 7,25 |
| | Distaloy DC | 6,91 | 7,20 | 7,35 | 6,72 | 7,03 | 7,22 |
| GS [MPA] | Distaloy AE | 18 | 27 | 28 | 8 | 12 | 13,5 |
| | Distaloy DC | 12 | 18 | 18 | 7 | 11 | 12 |
| SG [g/cc] | Distaloy AE | 7,05 | 7,25 | 7,40 | 6,83 | 7,08 | 7,25 |
| | Distaloy DC | 6,91 | 7,21 | 7,37 | 6,74 | 7,04 | 7,23 |
| TS [MPa] | Distaloy AE | 720 | 780 | 830 | 815 | 720 | 780 |
| | Distaloy DC | 645 | 720 | 780 | 575 | 665 | 725 |

GD = green density
GS = green strength
SD = sintered density
TS = tensile strength The above table discloses that the use of iron powders having alloying elements diffusion-bonded to the outer surfaces of unalloyed iron particles results in products having properties superior than what can be obtained if pre alloyed iron powders are used. This superiority is especially marked when a warm compacting process is used.

We claim:

1. A process for the preparation of a powder-metallurgical product having increased density including the following steps:

forming a mixture by mixing an iron powder, a high temperature lubricant and optionally an organic binder;

preparing a heated powder composition by heating the mixture to a temperature above ambient temperature;

transferring the heated powder composition to a preheated die;

forming a compacted body by compacting the heated powder composition in the die at an elevated temperature; and forming a sintered product by sintering the compacted body at a temperature of at least 1120° C.;

wherein the iron powder is a diffusion-bonded powder having one or more alloying elements diffused into the outer surfaces of unalloyed iron particles, and wherein the lubricant is added in one step.

2. The process according to claim 1, wherein the compacting is carried out in a single step and at a pressure between about 400 and 800 MPa.

3. The process according to claim 1, wherein the sintering is carried out in a single step.

4. The process according to claim 1, wherein both the compacting and the sintering are carried out as single steps.

5. The process according to claim 4, wherein the alloying elements are selected from Ni, Cu, Mo, Cr, Mn and Si.

6. The process according to claim 1, wherein the powder composition and the die are preheated to at least 120° C.

7. The process according to claim 6, wherein the composition is compacted at a temperature of at least 120° C.

8. The process of claim 1, wherein the lubricant is selected from the group consisting of polyamides or oligomer compounds of amide type, optionally in combination with metal soaps and/or waxes.

9. A product prepared according to the process of claim 1 having a sintered density between about 7.1 and 7.5 g/cc.

10. The product according to claim 9 including 0–6% Ni, 0–5% Cu, 0–6% Mo, 0–4% Cr, 0–4% Mn and 0–3% Si.

11. A green body prepared from an iron powder having at least one alloying element diffusion-bonded to the outer surfaces of unalloyed iron particles, the green body having a green density between about 7.0 and 7.5 g/cc when warm compacted at a pressure between about 400 and 800 MPa and at a temperature above 120° C.

12. Use of an iron powder having at least one alloying element diffusion-bonded to the outer surfaces of unalloyed iron particles for the preparation of single compacted and single sintered products having a sintered density between about 7.1 and 7.5 g/cc.

13. The process according to claim 2, wherein the sintering is carried out in a single step.

14. The process according to claim 2, wherein both the compacting and the sintering are carried out as single steps.

15. The process according to claim 3, wherein both the compacting and the sintering are carried out as single steps.

16. The process according to claim 2, wherein the powder composition and the die are preheated to at least 120° C.

17. The process according to claim 3, wherein the powder composition and the die are preheated to at least 120° C.

18. The process according to claim 2, wherein the lubricant is selected from the group consisting of polyamides or oligomer compounds of amide type, optionally in combination with metal soaps and/or waxes.

19. A product prepared according to the process of claim 2, having a sintered density between about 7.1 and 7.5 g/cc.

20. A green body prepared from an iron powder having at least one alloying element diffusion-bonded to the outer surfaces of unalloyed iron particles, the green body having a green density between about 7.0 and 7.5 g/cc when warm compacted at a pressure between about 400 and 800 MPa and at a temperature above 150° C.

21. The process according to claim 1, wherein the iron powder has a carbon content of ≦0.1 weight %.

22. The process according to claim 1, wherein the mixture is heated to 120 to 370° C. during the heating step.

23. The process according to claim 1, wherein the sintered product has a sintered density of at least 7.05 g/cc.

24. The process according to claim 1, wherein the sintered product has a tensile strength of at least 720 MPa.

25. The process according to claim 1, wherein the compacted body has a green density of at least 7.05 g/cc.

26. The process according to claim 1, wherein the compacted body has a green strength of at least 18 MPa.

27. A process for the preparation of a powder-metallurgical product having increased density including the following steps:

forming a mixture by mixing an iron powder, a high temperature lubricant and optionally an organic binder;

preparing a heated powder composition by heating the mixture to a temperature above ambient temperature;

transferring the heated powder composition to a preheated die;

forming a compacted body in a single step by compacting the heated powder composition in the die at a temperature of 120° C. to 370° C., the compacted body having a green strength of at least 18 MPa; and forming a sintered product by sintering the compacted body in a single step at a temperature of at least 1120° C., the sintered product having a sintered density of at least 7.05 g/cc and a tensile strength of at least 720 MPa.;

wherein the iron powder has less than 0.01% C and is a diffusion-bonded powder having one or more alloying elements diffused into the outer surfaces of unalloyed iron particles and the lubricant is added in one step.

* * * * *

UNITED STATES PATENT AND TRADEMARK OFFICE

CERTIFICATE OF CORRECTION

PATENT NO. : 5,926,686

DATED : July 20, 1999

INVENTOR(S) : Ulf Engström and Björn Johansson

It is certified that error appears in the above-indentified patent and that said Letters Patent is hereby corrected as shown below:

On the title page, insert the following item:
"Related U.S. Application Data":

-- [30] Foreign Application Priority Data

May 9, 1994 [SE] Sweden.....9401623-5--

Column 3, line 10 of table, delete "SG" and insert --SD--.

Column 3, next to last line of table, delete "815" and insert --615--.

Signed and Sealed this
First Day of February, 2000

*Attest:*

*Attesting Officer*

Q. TODD DICKINSON

*Acting Commissioner of Patents and Trademarks*